United States Patent [19]

Lu et al.

[11] 4,349,428

[45] Sep. 14, 1982

[54] CARBON CLOTH SUPPORTED ELECTRODE

[75] Inventors: Wen-Tong P. Lu, Upper St. Clair; Robert L. Ammon, Baldwin both of Pa.

[73] Assignee: The United States of America as represented by the U.S. Dept. of Energy, Washington, D.C.

[21] Appl. No.: 269,135

[22] Filed: Jun. 1, 1981

[51] Int. Cl.[3] ..... C25B 11/08; C25B 11/12

[52] U.S. Cl. ..... 204/294; 204/291

[58] Field of Search ..... 204/129, 104, 294, 291

[56] References Cited

U.S. PATENT DOCUMENTS

| | | | |
|---|---|---|---|
| 3,389,200 | 6/1968 | Olstowski et al. | 204/105 |
| 3,856,574 | 12/1974 | Amagi et al. | 136/120 FC |
| 4,193,860 | 3/1980 | Folser | 204/284 |

*Primary Examiner*—R. L. Andrews

*Attorney, Agent, or Firm*—R. D. Fuerle

[57] ABSTRACT

A flow-by anode is disclosed made by preparing a liquid suspension of about 8 to about 18% by weight solids, the solids comprising about 3.5 to about 8% of a powdered catalyst of platinum, palladium, palladium oxide, or mixtures thereof; about 60 to about 76% carbon powder (support) having a particle size less than about 20 mμm and about 20 to about 33% of an inert binder having a particle size of less than about 500 mμm. A sufficient amount of the suspension is poured over a carbon cloth to form a layer of solids about 0.01 to about 0.05 cm thick on the carbon cloth when the electrode is completed. A vacuum was applied to the opposite side of the carbon cloth to remove the liquid and the catalyst layer/cloth assembly is dried and compressed at about 10 to about 50 MPa's. The binder is then sintered in an inert atmosphere to complete the electrode. The electrode is used for the oxidation of sulfur dioxide in a sulfur based hybrid cycle for the decomposition of water.

15 Claims, 3 Drawing Figures

CARBON CLOTH SUPPORTED ELECTRODE

GOVERNMENT CONTRACT CLAUSE

The Government has rights in this invention pursuant to Contract No. JPL-955-380 awarded by the Jet Propulsion Laboratories.

BACKGROUND OF THE INVENTION

U.S. Pat. No. 3,888,750 discloses a process for decomposing water which involves the following electrolytic reactions:

$$SO_2+2H_2O \rightarrow H_2SO_4+2H^++2e^- \quad (1)$$

$$2\,H^++2\,e^- \rightarrow H_2 \quad (2)$$

These reactions take place in an electrolytic cell, the first reaction occurring at the anode and the second reaction at the cathode.

One of the difficulties in making this process efficient has been finding an anode which would be stable in the concentrated sulfuric acid anolyte and which would require as little electrical energy as possible to oxidize the $SO_2$ to sulfuric acid. Until now the best anode that has been found is a porous carbon plate which has been impregnated with a platinum catalyst. While a carbon plate anode works satisfactorily in the cell, it has poor long-term stability and requires more electrical energy to oxidize the sulfur dioxide than is desirable. Also, the carbon plate anode is not flexible and therefore can be easily broken when incorporated in a cell stack which is generally used for constructing a hydrogen production plant.

SUMMARY OF THE INVENTION

We have invented a carbon cloth supported electrode for the oxidation of sulfur dioxide which is much more stable than was the previous carbon plate electrode. Also, the electrode of this invention uses less platinum catalyst and requires less electrical energy to oxidize a given amount of sulfur dioxide than the previous carbon plate electrode. The electrode is more flexible than the carbon plate electrode and therefore is less subject to breakage during handling and incorporating into the electrolytic cell. And finally, the electrode of this invention is less expensive than the carbon plate electrode.

PRIOR ART

U.S. Pat. No. 4,193,860 discloses a liquid permeable electrode made by compressing catalyzed activated carbon and a resin which is later pyrolyzed.

U.S. Pat. No. 3,856,574 discloses a carbon electrode made from hollow carbon microspheres in a thermosetting resin which is later carbonized.

U.S. Pat. No. 3,389,200 discloses an anode prepared from compressed vermicular graphite containing a polyethylene or phenol-formaldehyde binder.

DESCRIPTION OF THE INVENTION

Figure 1:
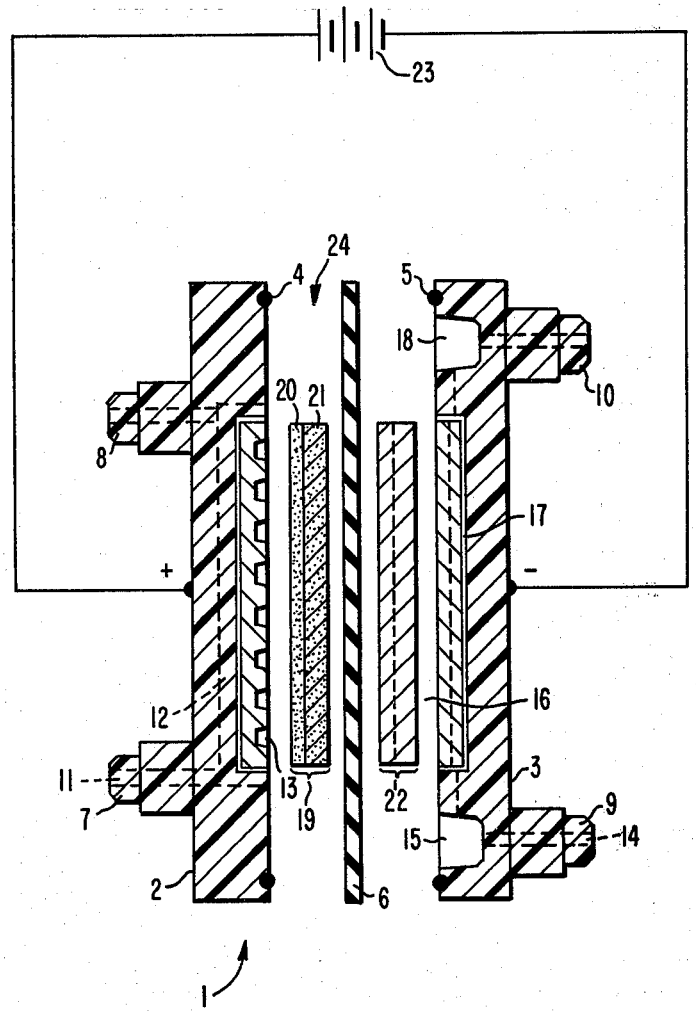
FIG. 1 is a schematic view of a certain presently preferred embodiment of a disassembled test cell employing the electrode of this invention.

In FIG. 1, an electrolyzer 1 is formed of a left portion 2 and a right portion 3 of an inert insulating material such as Lucite plastic, which are sealed by O-rings 4 and 5 to gas separator 6, which may be, for example, a microporous rubber diaphragm or an ion exchange membrane. Left portion 2 is provided with an anolyte inlet 7 and anolyte outlet 8 and right portion 3 is provided with a catholyte inlet 9 and a catholyte-and-hydrogen outlet 10. Channel 11 leads from anolyte inlet 7 to anolyte distributor 12 to grooved anodic current collector 13 then to the anolyte outlet 8. Similarly channel 14 leads from the catholyte inlet 9 to catholyte distributor 15 to cathodic current collector 16 to catholyte reservoir 18 to catholyte outlet 10. Anode chamber 24 contains carbon cloth anode 19 which has a layer of catalyzed carbon powder 20 on a carbon cloth 21. Cathode chamber 17 contains a carbon plate cathode 22. Anode 19 and cathode 22 are connected to the positive and negative terminals, respectively, of a DC power source 23.

In operation, sulfuric acid solution presaturated with sulfur dioxide enters the electrolyzer by anolyte nlet 7, fills anolyte distributor 12, and passes horizontally through the grooved anodic current collector 13. Simultaneously, the catholyte of sulfuric acid enters catholyte inlet 9, fills catholyte distributor 15 and flows along the vertical channels of the cathodic current collector 16.

By passing a direct current across the anodic current collector 13 and the cathodic current collector 16, sulfur dioxide in the electrolyte is electrocatalytically oxidized at the anode 19, producing sulfuric acid, hydrogen ions and electrons according to the equation:

$$SO_2+2H_2O \rightarrow H_2SO_4+2H^++2e^- \quad (3)$$

The sulfuric acid product and the unreacted sulfur dioxide exit the cell through the anolyte outlet 8, along with the electrolyte. The hydrogen ions move through the separator 6, and recombine with electrons which pass via the external circuit to generate hydrogen gas at the cathode 22 according to the equation:

$$2H^++2e \rightarrow H_2 \quad (4)$$

After being collected in the catholyte reservoir 18, hydrogen gas exits the cell with the electrolyte through the catholyte outlet 10.

While FIG. 1 shows a test cell, an actual commercial cell would employ the same elements in a scaled-up version.

The electrode of this invention is formed on a clean carbon cloth. Carbon seems to be the only suitable material for the cloth as it is both conductive and stable in the concentrated sulfuric acid. The cloth may be woven or matted, but a woven cloth is preferred as it is more flexible and can be bent without breaking. A cloth having small fibers is preferred as it presents a larger surface area; the surface area should preferably be greater than 10 $m^2/g$. Cloths of any width or length may be used, and they are typically about 0.02 to about 0.15 millimeter thick. Before being used to manufacture the electrode, the cloth should be degreased and cleaned to remove any contamination which might be present.

In the next step of the invention a suspension of a catalyzed carbon powder is prepared. In order to obtain a high surface area which maximizes the reaction rate, the carbon powder should be less than 20 mμm in size. The carbon powder is catalyzed with an extremely-fine-particle catalyst which may be platinum, palladium, palladium oxide, or a mixture of any of the three. Other catalysts have not been found which are stable in the sulfuric acid anolyte. A suspension preferably of about 15 to about 30% solids is prepared of the catalyzed carbon powder in any liquid which is not a solvent for the solids. Water is the preferred liquid as it is inexpensive and non-contaminative but organic liquids such as methanol, ethanol or iso-propanol could also be used. About 5 to about 10% by weight of the solids in the suspension is catalyst and the remaining 90 to 95% by weight is carbon powder.

A second suspension of a binder is also prepared in any liquid which is not a solvent for the solids, preferably of about 2 to about 5 solids. Water is again preferred but an organic liquid such as methanol, ethanol, or iso-propanol could also be used. The binder can be any inert thermosetting or thermoplastic polymeric material such as polytetrafluoroethylene, polyvinylidene fluoride, or fluorinated ethylene propylene, but polytetrafluoroethylene is preferred as it is stable and flows during sintering to bind the catalyzed carbon powder to the carbon cloth. The binder must have a particle size of less than about 500 mμm so that it will mix well and bind well with the carbon powder. The two suspensions are preferably prepared separately because when they are prepared together the catalyzed carbon powder and the binder tend to separate and form distinct layers. However, if the entire quantity of suspension were to be agitated and used, a single suspension could be prepared. In that case, the suspension would contain about 6.5 to about 14% carbon powder, about 0.5 to about 1.5% supported catalyst particles, about 1 to about 2.5% binder, and would be about 8 to about 18% solids.

In the next step of the process of the invention it is necessary to apply the mixture of the two suspensions to the carbon cloth and remove the water from the suspensions. This operation can most advantageously be performed by placing the carbon cloth on a perforated horizontal plate and applying a vacuum to the opposite side of the plate. The two suspensions are then mixed, if they were separately prepared, and are poured evenly over the cloth. Enough vacuum is applied to remove the water within a reasonable time but not enough vacuum is used to draw the particles of carbon through the cloth. A vacuum of about ½ to about 2 millimeters of mercury has been found to be satisfactory for this purpose. If no vacuum is used, the mixture of binder and catalyzed carbon powder may separate into two layers before drying, resulting in a poor quality electrode. A sufficient quantity of the suspension should be poured onto the cloth to result in a solid layer about 0.02 to about 0.1 centimeters thick when the electrode is completed.

The carbon cloth with a catalyst layer is then dried. Drying may be accomplished by heating, for example, at about 40° C. for an hour. This can be done in situ using an overhead infrared lamp.

The dried catalyst layer/cloth assembly is then compressed to form a solid article. At least 10 mega pascals (MPa) of pressure should be used to improve the adhesion in the interface of cloth and catalyst layer, but the pressure should not exceed about 50 mega pascals as that may result in the breaking of the cloth.

In the final step of the process of this invention the compressed catalyst/cloth assembly is heated in an inert atmosphere to sinter the binder. If the catalyst is platinum or palladium, the inert atmosphere is preferably hydrogen as it removes any oxides which may have formed on the catalyst surface. If the catalyst is palladium oxide, however, another inert gas such as nitrogen should be used. The sintering is performed at the sintering temperature of the particular binder used. If polytetrafluoroethylene is used, the sintering temperature is about 320° to about 360° C., and heating should be done within that range for about ½ to about 2 hours, depending upon the particular temperature selected.

The resulting electrode can be used as a flow-by anode for the oxidation of sulfur dioxide in concentrated sulfuric acid, generally having a concentration of about 20 to about 60%. Further details of the sulfur cycle water decomposition process in which the anode of this invention can be used may be found in U.S. Pat. No. 3,888,750, herein incorporated by reference, as well as other publications.

The following examples further illustrate this invention:

EXAMPLE 1

In these experiments a carbon cloth supported electrode according to this invention was compared to a conventional carbon plate electrode. The carbon cloth electrode was prepared from a carbon cloth supplied by Stackpole Fiber Company under the trade designation "SWB-8". The cloth was 5 cm×5 cm and 0.08 cm thick and had a flexural strength of 330 MPa. The cloth was degreased using acetone and then cleaned ultrasonically in distilled water for 15 minutes. A suspension was prepared by agitating 20 milliliters of distilled water, 0.55 grams of platinum catalyzed carbon powder consisting of 10 weight percent platinum with about 80% of the platinum particles less than 80 microns in size, supplied by Engelhard Corporation under the trade designation "C-9885," for 5 minutes using a glass stirrer. A second suspension was prepared by adding 0.275 grams of a polytetrafluoroethylene solution (60% polytetrafluoroethylene, 40% water) sold by Du Pont under the trade designation "30B," to 5 milliliters of distilled water with stirring. A perforated stainless steel plate 5 cm×5 cm was sealed to a Lucite fixture using Silastic silicone rubber and was allowed to settle for one hour. A Lucite plastic fixture was then positioned horizontally over a stainless steel support exposed to a cavity that was connected to a vacuum pump. The wet pretreated carbon cloth was placed on top of the stainless steel perforated plate, and the surface temperature of the cloth was heated to about 40° C. using an overhead infrared lamp to accelerate drying. The aqueous polytetrafluoroethylene suspension and the carbon suspensions were mixed together and gently stirred for about 2 minutes. The resulting suspension was poured evenly over the carbon cloth while a vacuum was applied to the other side of the cloth of about one millimeter of mercury. The cloth was then heated in situ with the infrared lamp at about 40° C. for one hour. A sheet of waxed paper was placed over the catalyst layer and the treated cloth was placed in a stainless steel compression die between two pieces of flat Teflon sheets. It was compressed at a pressure of about 15 to about 30 MPa. The electrode was removed from the compression die and the waxed paper was removed and the catalyst layer was sintered in a hydrogen atmosphere at 320° C. for 2 hours. The catalyst loading in the electrode was approximately 2 milligrams of platinum per centimeter squared, and the catalyst layer was about 0.03 to about 0.05 cm thick and contained about 20 to about 23 weight percent polytetrafluoroethylene. Resulting electrode exhibited great flexibility and electrical conductivity.

A carbon plate cathode of loading 10 mg-Pt/cm$^2$ was prepared by vacuum deposition of an appropriate amount of $H_2PtCl_6$ on a grooved carbon plate, followed by a thermal decomposition process under a hydrogen atmosphere at 600° C. Additional details on the carbon plate electrode can be found in U.S. Application Ser. No. 153,110 filed May 23, 1980 by W. P. Lu, entitled, "Process For Electrode Fabrication Having A Uniformly Distributed Catalyst Layer Upon A Porous Substrate."

Figure 2:
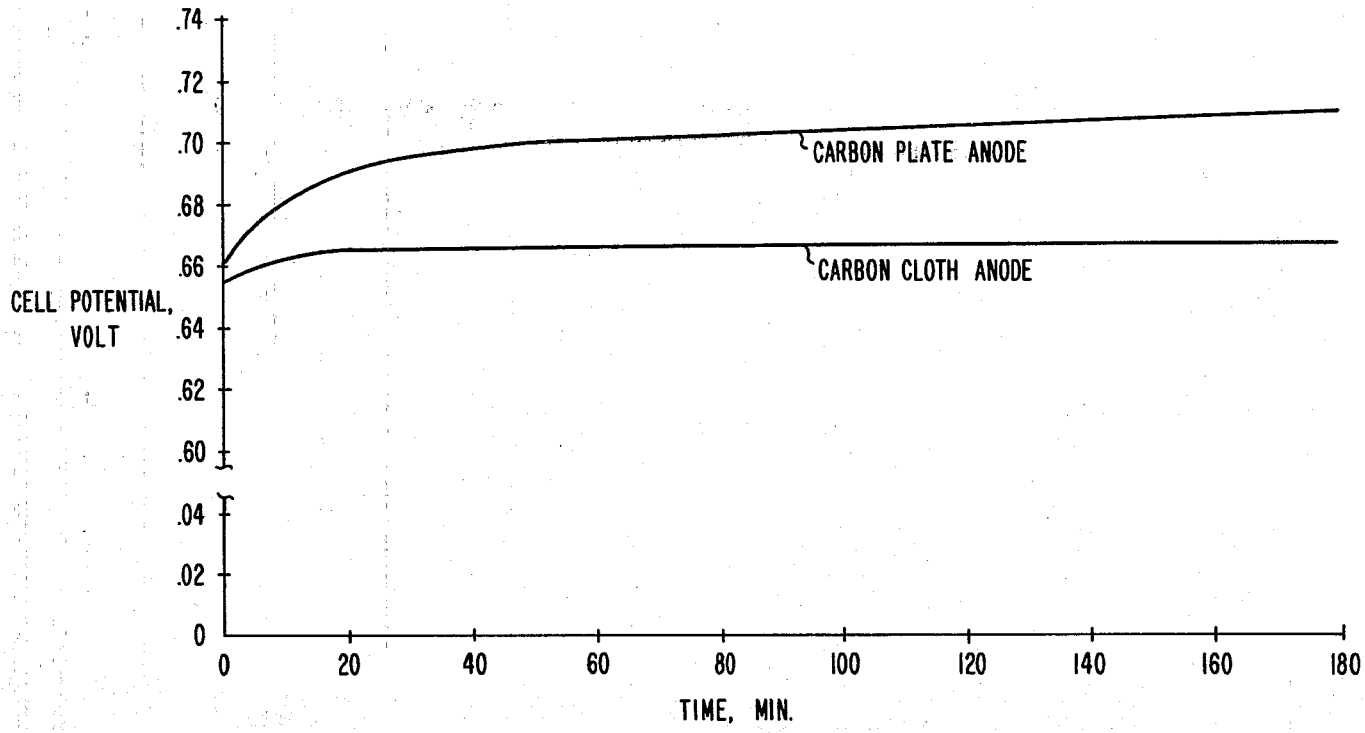
FIG. 2 is a graph comparing the stability of the electrode of this invention over time with a conventional carbon plate electrode.

An electrolyzer was prepared as in the drawing. The cell voltage of the two electrodes was tested as a function of time while they were operating in a constant current density of 100 mA/cm$^2$ (milliamperes per centimeter squared) in a 50 weight percent sulfuric acid solution at 50° C. and a pressure of one atmosphere. Apart from the different anode structures, similar cell components were used for the two electrolyzers for which the results are presented in FIG. 2. The carbon cloth supported anode was practically stable after one hour of operation whereas the conventional carbon plate electrode exhibited a significant performance degradation with time at approximately 5 mV/hr (millivolts per hour). After operating at 100 mg/cm$^2$ for 2½ hours, the carbon cloth electrode showed an improvement of 40 mV in cell voltage over the conventional carbon plate electrode.

EXAMPLE 2

Figure 3:
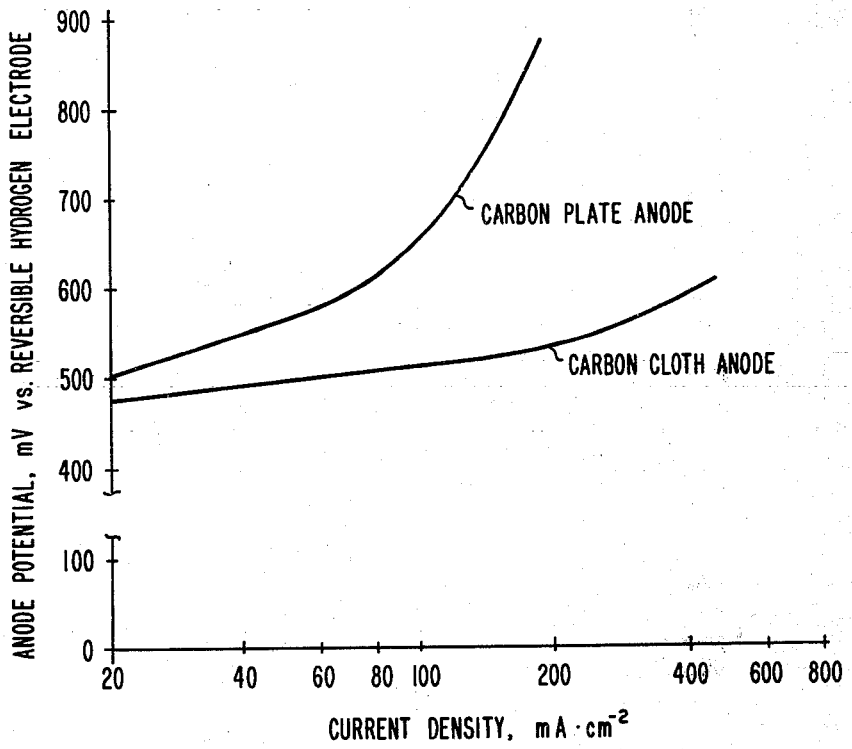
FIG. 3 is a graph comparing the performance of the electrode of this invention at different current densities with a conventional carbon plate electrode.

The same electrolyzer was used as in Example 1 and the electrode potential-current density relationship was measured and compared to an electrolyzer which used a carbon plate anode. As seen from FIG. 3, the use of a carbon-cloth backed anode significantly reduced the polarization potential for $SO_2$ oxidiation throughout the current densities of investigation. Furthermore, the performance improvement increased with rising current density. At 150 mA/cm$^2$, for example, the measured polarization potential of the carbon-cloth backed anode was ~230 mV lower than that at the Pt-catalyzed carbon plate anode. Conclusively, the invention of the carbon-cloth backed anode results in a great reduction in the achievable cell voltage, thus improving significantly the voltage efficiency of an electrolyzer. This result was somewhat surprising since the carbon cloth anode has only 7 mg/cm$^2$ of Pt, while the carbon plate anode had 10 mg/cm$^2$ of Pt.

We claim:

1. A method of making an electrode comprising:
(A) preparing a liquid suspension of about 8 to about 18% by weight solids, said solids comprising
(1) about 0.5 to about 1.5% by weight of supported catalyst particles selected from the group consisting of platinum, palladium, palladium oxide, and mixtures thereof;
(2) about 6.5 to about 14% carbon powder (support) having a particle size of less than about 20 mμm, and
(3) about 1 to about 2.5% by weight of an inert binder having a particle size less than about 550 mμm;
(B) pouring a sufficient amount of said suspension over a carbon cloth to form a layer of solids about 0.02 to about 0.1 cm thick on said carbon cloth when said electrode is completed;
(C) applying a vacuum to the opposite side of said carbon cloth to remove said liquid;
(D) drying said carbon cloth to form said layer of solids;
(E) compressing said carbon cloth and layer of solids at about 10 to about 50 MPa; and
(F) sintering said binder in an inert atmosphere.

2. A method according to claim 1 wherein said liquid which forms said suspension is water.

3. A method according to claim 1 wherein said suspension is prepared as two separate suspensions which are mixed before use, one suspension of about 15 to about 30% solids containing said carbon powder and said catalyst, and the other suspension of about 2 to about 5% solids containing said binder.

4. A method according to claim 1 wherein said binder is polytetrafluoroethylene.

5. A method according to claim 4 wherein said binder is sintered at about 320° to 360° C. for about ½ to about 2 hours.

6. A method according to claim 1 wherein said carbon cloth is placed on a perforated stainless steel plate before step (B).

7. A method according to claim 1 wherein said vacuum is about ½ to about 2 mm Hg.

8. A method according to claim 1 wherein said carbon cloth is dried by heating at about 40° C. for about one hour.

9. A method according to claim 1 wherein said carbon cloth has a surface area greater than about 10 m$^2$/g.

10. A method according to claim 1 wherein said carbon cloth is woven.

11. An electrode comprising:
(A) a carbon cloth;
(B) a layer about 0.01 to about 0.05 cm thick on the surface of said carbon cloth of a mixture of
(1) about 60 to about 76% by weight carbon powder (support) having a particle size less than about 20 mμm;
(2) about 3.5 to about 8% by weight of supported catalyst particles selected from the group consisting of platinum, palladium, palladium oxide, and mixtures thereof; and
(3) about 20 to about 33% by weight of a sintered binder in a weight ratio to said carbon powder of about 1:4 to about 1:2.

12. An electrode according to claim 11 wherein said binder is polytetrafluoroethylene.

13. An electrode according to claim 11 wherein said carbon cloth has a surface area greater than about 10 m$^2$/g.

14. An electrode according to claim 11 wherein said carbon cloth is woven.

15. In a sulfur cycle process for the decomposition of water, a method of oxidizing sulfur dioxide to sulfuric acid comprising using an electrode according to claim 11 as the anode in said process.

* * * * *